US008776266B1

(12) United States Patent
Metz

(10) Patent No.: US 8,776,266 B1
(45) Date of Patent: Jul. 15, 2014

(54) HUNTING GARMENT AND SAFTEY HARNESS SYSTEM

(76) Inventor: Johnathan Metz, Fairmont, WV (US)

( * ) Notice: Subject to any disclaimer, the term of this patent is extended or adjusted under 35 U.S.C. 154(b) by 444 days.

(21) Appl. No.: 13/090,667

(22) Filed: Apr. 20, 2011

(51) Int. Cl.
*A41D 13/00* (2006.01)

(52) U.S. Cl.
USPC ..... 2/94; 2/93

(58) Field of Classification Search
USPC ..... 2/69, 2.5, 102, 94
See application file for complete search history.

(56) References Cited

U.S. PATENT DOCUMENTS

| | | | | |
|---|---|---|---|---|
| 3,973,643 | A * | 8/1976 | Hutchinson | 182/3 |
| 4,302,847 | A * | 12/1981 | Miles | 2/465 |
| 4,347,629 | A * | 9/1982 | Itoi | 2/108 |
| 4,731,882 | A * | 3/1988 | Ekman | 2/69 |
| 5,718,000 | A * | 2/1998 | Ost et al. | 2/69 |
| 5,738,046 | A * | 4/1998 | Williams et al. | 119/770 |
| 6,029,270 | A * | 2/2000 | Ost et al. | 2/2.5 |
| 6,101,631 | A * | 8/2000 | Ferguson, Jr. | 2/94 |
| 6,256,789 | B1 | 7/2001 | Young et al. | |
| RE37,394 | E * | 10/2001 | Woodyard | 2/102 |
| 6,658,666 | B2 | 12/2003 | Schweer | |
| 6,698,026 | B2 * | 3/2004 | Schweer | 2/94 |
| 6,892,395 | B2 * | 5/2005 | Schweer | 2/94 |
| 7,665,153 | B2 * | 2/2010 | Grilliot et al. | 2/69 |
| 7,818,818 | B2 * | 10/2010 | Grilliot et al. | 2/94 |
| 8,056,675 | B2 * | 11/2011 | Helms | 182/3 |
| 8,091,151 | B2 * | 1/2012 | Johnson et al. | 2/455 |
| 8,375,467 | B2 * | 2/2013 | Real et al. | 2/69 |
| 8,430,204 | B1 * | 4/2013 | Reynolds | 182/3 |

* cited by examiner

*Primary Examiner* — Richale Quinn
(74) *Attorney, Agent, or Firm* — Montgomery Patent & Design; Robert C. Montgomery

(57) ABSTRACT

A hunting garment system including a safety harness which restrains a hunter while perched on a tree stand, an outer member, and an inner member. Both the inner member and the outer member include detachable sleeves and a detachable hood allowing the hunter to select a particular weather-conforming configuration. The safety harness is designed to be safely anchored onto a tree and is worn alone, beneath the outer member, beneath the inner member, beneath an outer vest, beneath an inner vest, or in combination with an assembly of the outer member over the inner member.

16 Claims, 13 Drawing Sheets

HUNTING GARMENT AND SAFTEY HARNESS SYSTEM

RELATED APPLICATIONS

The present invention was first described in a notarized Official Record of Invention on Sep. 14, 2009, that is on file at the offices of Montgomery Patent and Design, LLC, the entire disclosures of which are incorporated herein by reference.

FIELD OF THE INVENTION

The present invention relates generally hunting garments, and in particular, a hunting garment and safety harness system.

BACKGROUND OF THE INVENTION

Over the years, modern advances in hunting equipment have enhanced the sport and have provided hunters with increased success. Although many of these products are high-technology devices, some products are amazingly simple. An example of one (1) of these products is the tree stand. A tree stand is used to form a stable surface in a tree upon which the hunter may sit or even stand. It allows the hunter to remain elevated and nearly invisible to his prey for long periods of time in relative comfort. However, as with many hunting products, there is a relative amount of danger associated with the tree stand; particularly, when one takes into account the distance above ground and the possibility of losing one's balance. This danger is enhanced with the recoil of a rifle and falling becomes a high probability.

To address this problem and danger, various hunting garments having enhanced safety features have been developed. One (1) in particular is the inclusion of a safety harness system integrated into the garment itself which allows hunters to secure themselves safely in the elevated position. Examples of such can be seen by reference in the following U.S. patents. U.S. Pat. No. 5,738,046 issued to Williams et al. discloses a safety jacket and harness system. U.S. Pat. No. 6,101,631 issued to Ferguson, Jr. discloses a built-in full-body harness system for hunters. U.S. Pat. No. 6,256,789 issued to Young et al. discloses a combination garment and safety harness. U.S. Pat. No. 6,658,666 issued to Schweer discloses a hunting garment with safety device. U.S. Pat. No. 6,892,395 issued to Schweer discloses a safety garment having safety harness.

While these attempts may achieve their purported objectives each suffers from one (1) or more disadvantage or deficiency related to design or utilization. Particularly, each one (1) is restrictive relative to the safety tether connecting to the safety harness. During hunting activities it is necessary to be able to freely move and quickly. These movements include squatting, sitting, and drawing a weapon. These movements can be restricted depending upon how the tether is attached to the hunter. Additionally, these devices lack the ability to customize the hunting attire based on the elements and other weather circumstances, which regularly change throughout the day when hunting.

SUMMARY OF THE INVENTION

The inventor has therefore recognized the aforementioned inherent problems and lack in the art and observed that there is a need for a device by which a hunter in a tree stand can be protected from falls, yet retain unrestricted mobility and can conveniently adjust to the changing weather conditions. In accordance with the invention, it is an object of the present disclosure to solve these problems.

The inventor recognized these problems and has addressed this need by developing a hunting garment and safety harness system that provides hunters who hunt from tree stands an increased measure of safety and a more steady and sure shot in a manner which is quick, easy, and effective. The inventor has thus realized the advantages and benefits of providing a safety harness worn on a torso of a user having a harness vest, a plurality of adjustable straps affixed to an interior of the harness vest securable around the torso of the user, and a harness vest opening disposed through an upper middle location of the harness vest. An inner member is provided to be worn on the torso of the user having an inner vest, a pair of detachable sleeves, and an inner vest opening disposed through an upper middle location of the inner vest. An outer member is provided to be worn on the torso of the user comprising an outer vest, a pair of detachable sleeves, and an outer vest opening disposed through an upper middle location of the outer vest. A tether strap is slidably coupled to a central location of the plurality of straps of the safety harness.

The inner member is selectably wearable as a separate article or as combined over top of the safety harness. The outer member is selectably wearable as a separate article, as combined over top of the safety harness, or as combined over top of the inner member and safety harness. The vest openings provide access for the tether strap to be coupled to the plurality of straps. The vest openings align when the safety harness, the inner member, and the outer member are worn in any combination.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
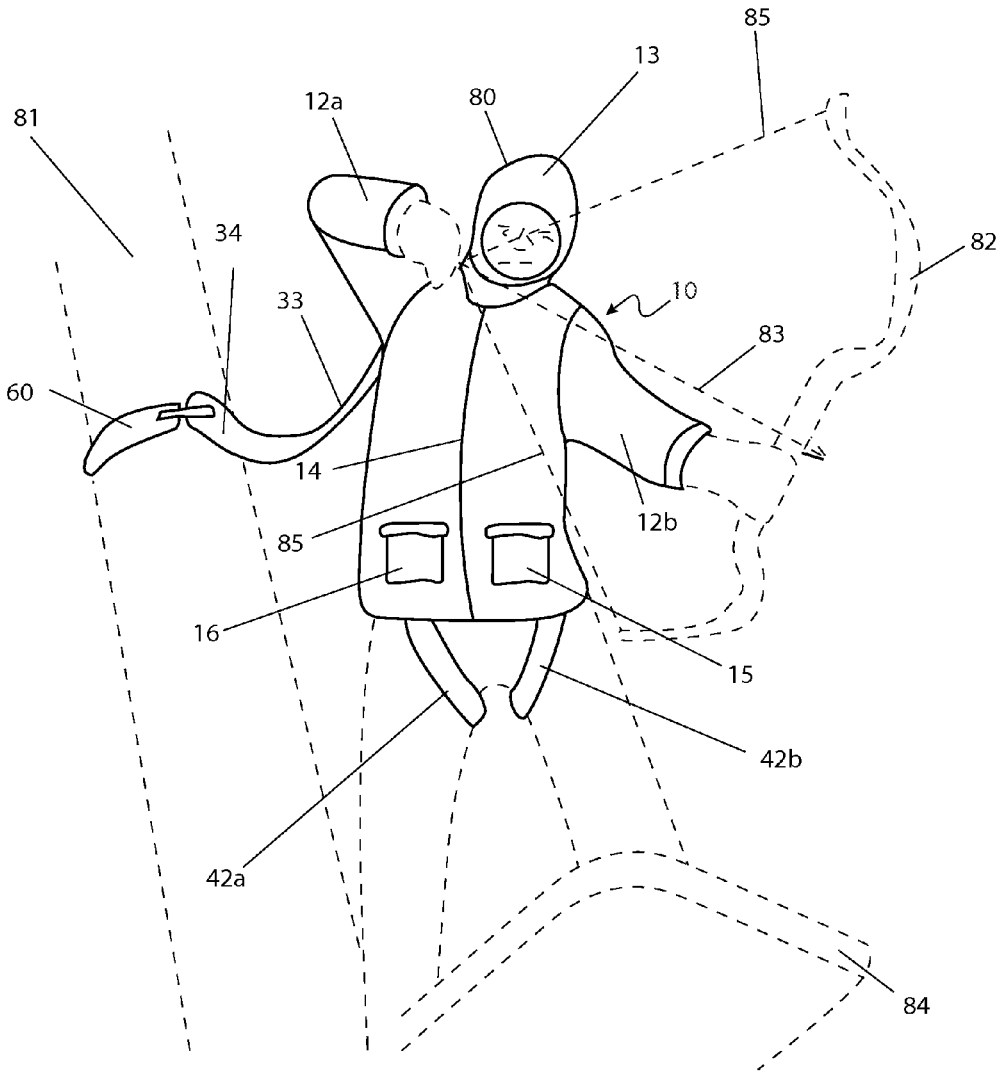
FIG. 1 is an environmental view of a hunting garment and safety harness system, according to a preferred embodiment in accordance with the invention.

10 hunting garment and safety harness system
11 outer member
12*a* first sleeve
12*b* second sleeve
13 hood
14 first closure
15 first pocket
16 second pocket
17 outer vest
18 arm opening
20 inner member
21 inner vest
22*a* third sleeve
22*b* fourth sleeve
24 second closure
25 third pocket
26 fourth pocket
27 fifth pocket
28 sixth pocket
30 safety harness
32 harness vest
33 tether strap
34 tether loop
35 tether ring
36 harness vest opening
37 sternum strap
38*a* first sternum strap buckle
38*b* second sternum strap buckle
39 tear-away fold
40*a* first shoulder strap
40*b* second shoulder strap
42*a* first leg strap
42*b* second leg strap
43*a* first leg strap buckle
43*b* second leg strap buckle
44 waist strap
45*a* first waist strap buckle
45*b* second waist strap buckle
46 inner slide strap
47 joining strap
48 rivet
49 outer slide strap
50 waist strap loop
51*a* first fasteners
51*b* second fastener
53*a* third fastener
53*b* fourth fastener
55 hood fastener
58 hood adjusting string
59 string barrel
60 tree strap
61 locking plunger
70 sewn attachment
72 first snap fastener
80 user
81 tree
82 bow
83 arrow
84 tree stand
85 bow string
90 outer vest opening
92 outer vest flap
93 second snap fastener
96 inner vest opening
98 inner vest flap
100 third snap fastener

DETAILED DESCRIPTION OF THE PREFERRED EMBODIMENT

In accordance with the invention, the best mode is presented in terms of a preferred embodiment, herein depicted within FIGS. 1 through 13. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 13, depicting a hunting garment and safety harness system (herein described as a "system") 10, where like reference numerals represent similar or like parts. The system 10 provides for keeping a user 80 safely tethered to a support structure, such as tree 81, and protecting the user 80 from inclement weather. The system 10 is particularly suited for users 80 while hunting from a tree stand 84.

FIG. 1 shows an environmental view of the system 10. Although the user 80 is depicted as hunting with bow 82, the system 10 is intended to be equally useful when the user 80 hunts with a rifle, a crossbow, a shotgun, or any other type of weapon. The system 10 generally includes a safety harness 30, an outer member 11, a hood 13, a tether strap 33, a tether loop 34, and a tree strap 60. The user 80 is depicted as standing on a tree stand 84 while safely tethered to a tree 81 by a combination of the tether strap 33, the tether loop 34, and the tree strap 60.

Figure 2:
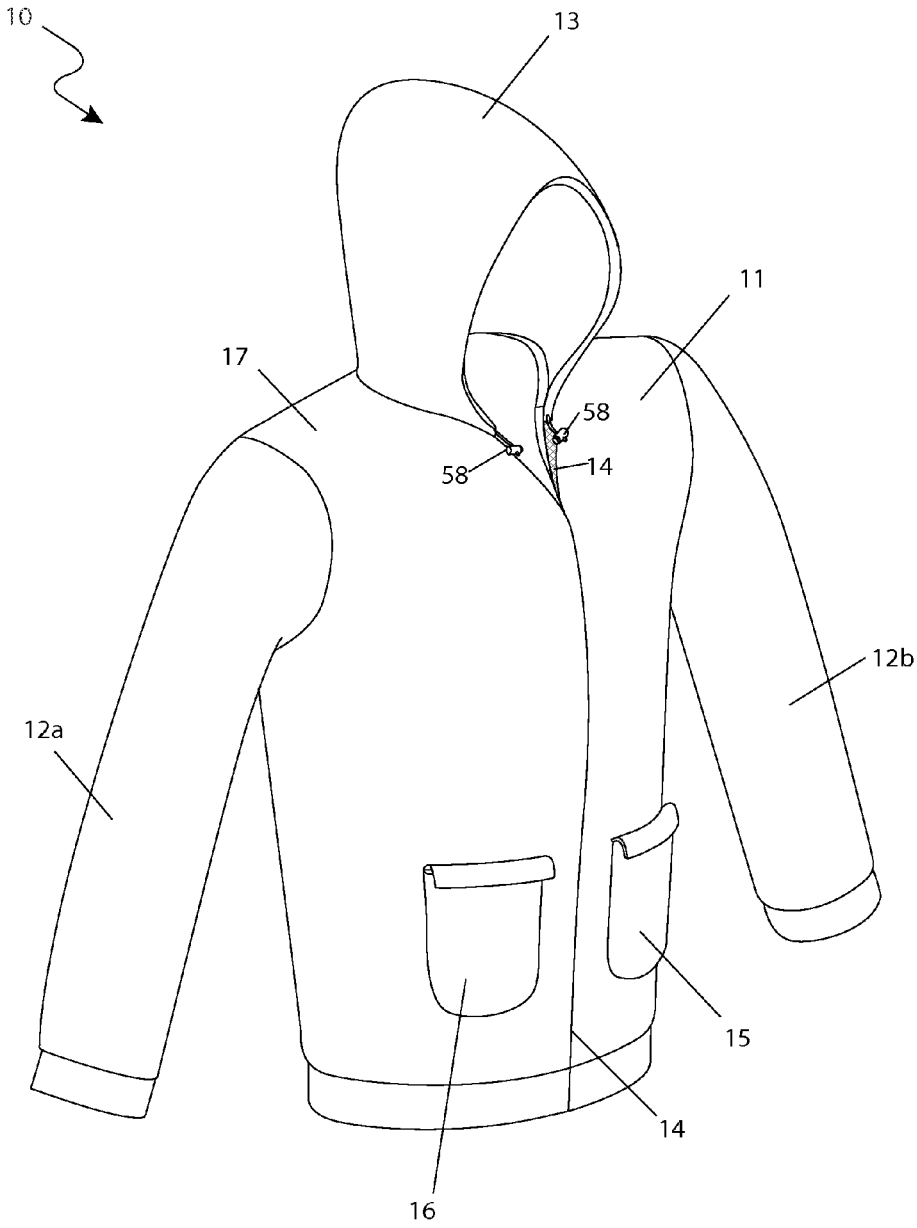
FIG. 2 is a front perspective view of an outer member, according to the preferred embodiment.

FIG. 2 shows a front perspective view of the outer member 11. The outer member 11 is a waterproof or insulated shell which can be worn separately or over the inner member 20. The outer member 11 includes a first sleeve 12*a*, a second sleeve 12*b*, and a hood 13; which are all detachably fastened to an outer vest 17. The outer member 11 also includes a first pocket 15, a second pocket 16, and a first closure 14. The first closure 14 is preferably a zipper, a hook-and-loop-type fastener, or a plurality of snaps. The outer member 11 is preferably made of a waterproofed material, such as, but not limited to: rubberized fabric, NYLON®, silk, or a silk-like plastic.

Figure 3:
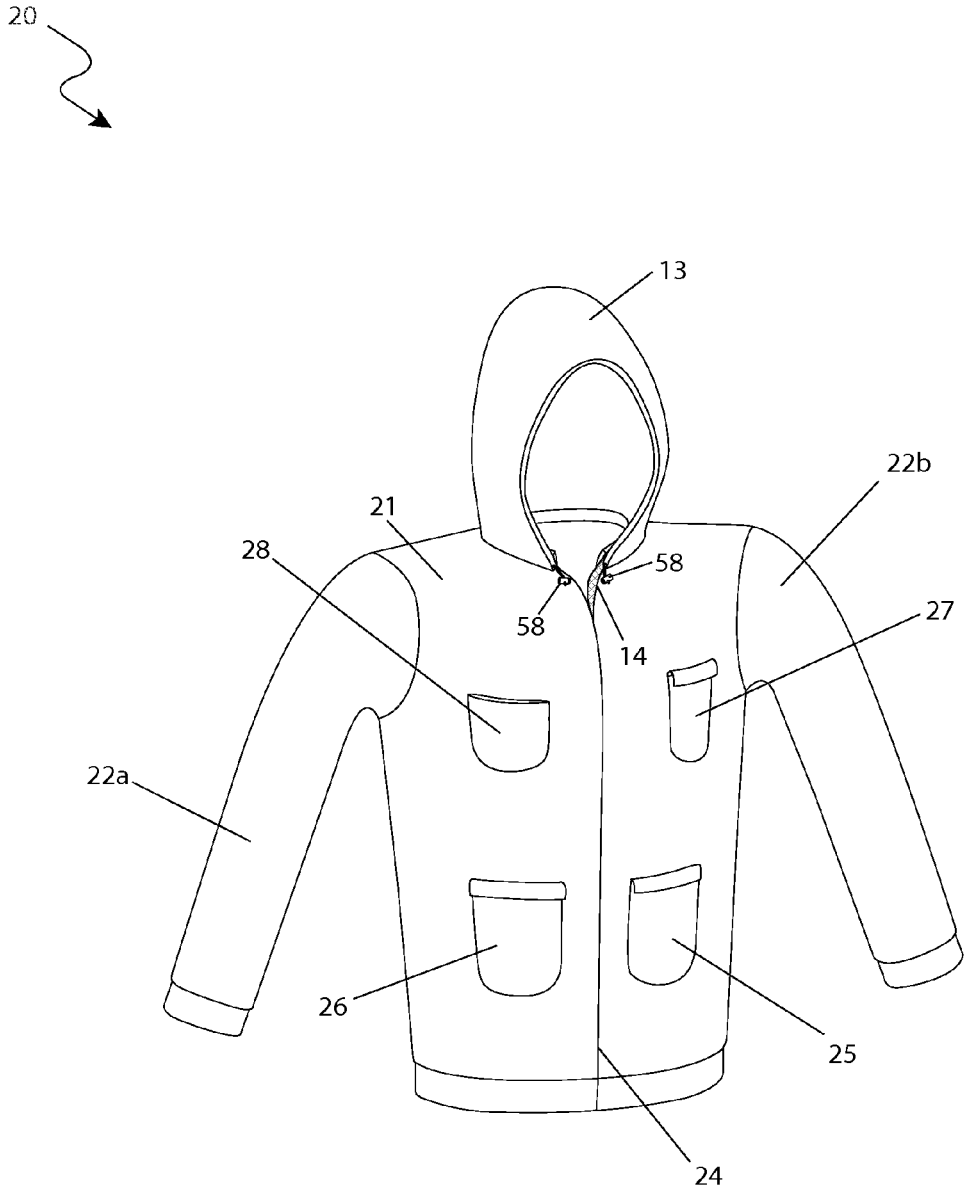
FIG. 3 is a front perspective view of an inner member, according to the preferred embodiment.

FIG. 3 shows a front perspective view of the inner member 20. The inner member 20 is a waterproof or insulated jacket which can be worn separately or under the outer member 11. The inner member 20 includes a third sleeve 22*a*, a fourth sleeve 22*b* and the hood 13; which are all detachably fastened to a inner vest 21. The inner member 20 also includes a third pocket 25, a fourth pocket 26, a fifth pocket 27, a sixth pocket 28, and a second closure 24. The second closure 24 is preferably a zipper, a hook-and-loop-type fastener, or a plurality of snaps. The inner member 20 is preferably made of materials such as, but not limited to: canvas, natural or artificial leather, NYLON® or a rubberized fabric. An exterior layer of material is separated from an interior layer of material by an insulating material such as, but not limited to: foam rubber, natural or synthetic wool, down, or cotton fiber.

Figure 4:
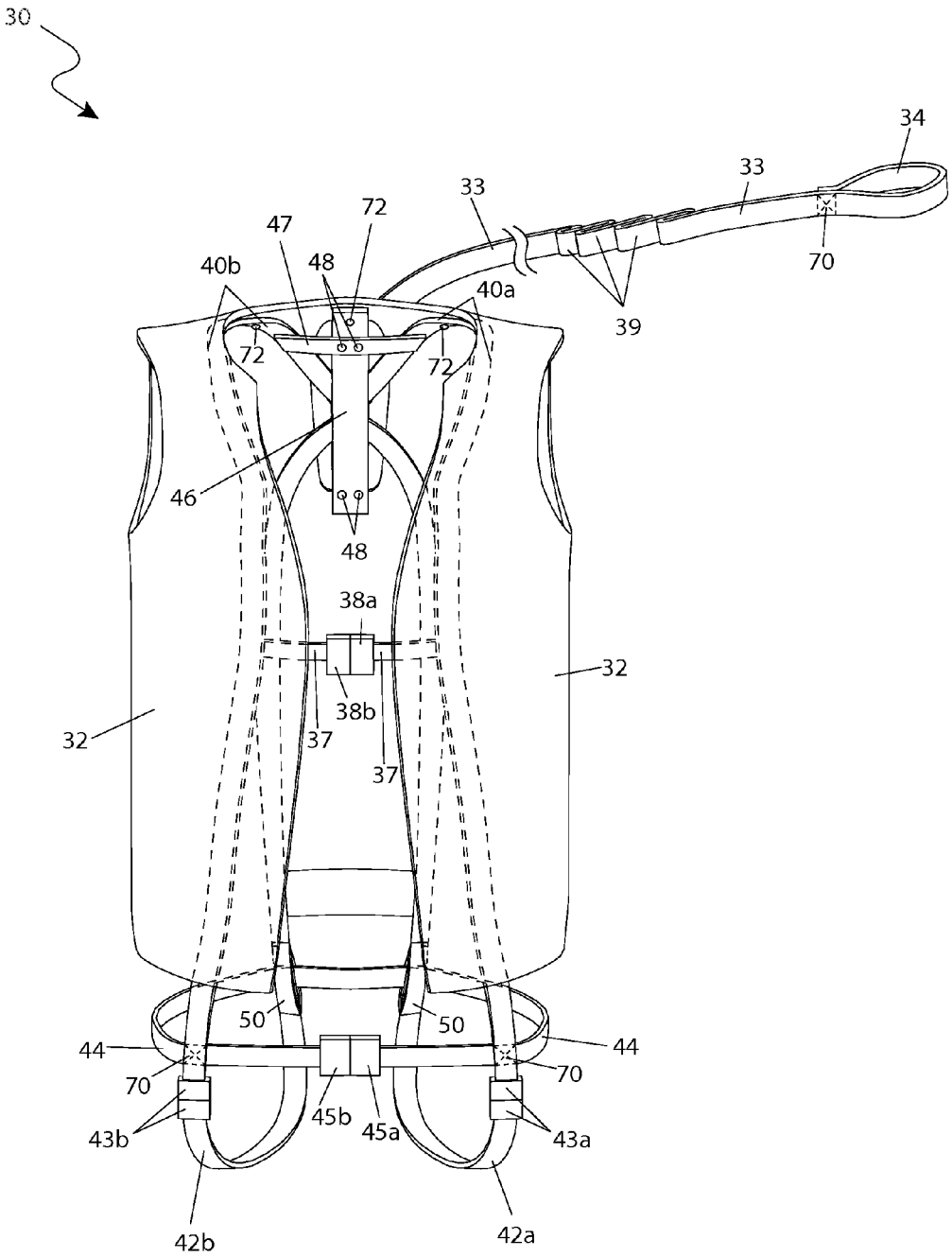
FIG. 4 is a front perspective view of a safety harness, according to the preferred embodiment.

FIG. 4 shows a front view of the safety harness 30. The safety harness 30 can be worn separately, underneath the outer member 11, underneath the inner member 20, or under a combined assembly of the inner member 20 and the outer member 11. The safety harness 30 is preferably made in an adjustable configuration and of materials similar to a safety straps and harnesses, such as those worn by construction workers. The safety harness 30 includes the tether strap 33 and the tether loop 34. The tether strap 33 is adjustably fastened onto the safety harness 30 by a tether ring 35 (see FIG. 6). The safety harness 30 also includes a harness vest 32 having a pair of arm openings 18 and a sternum strap 37. The sternum strap 37 provides a closure across the chest area of the user 80 and is removably joined by inserting and locking a first sternum strap buckle 38*a* and a second sternum strap buckle 38*b*.

The harness vest 32 includes a plurality of internal joined straps including a first shoulder strap 40*a*, a second shoulder strap 40*b*, a first leg strap 42*a*, a second leg strap 42*b*, a waist strap 44, an inner slide strap 46, a joining strap 47, and an outer slide strap 49. The straps 40*a*, 40*b*, 42*a*, 42*b*, 44, 46, 47, 49 are preferably fabricated from heavy-duty strapping material approximately two (2) inches in width and made of polyester, nylon, or equivalent strapping material. The straps 40*a*, 40*b*, 42*a*, 42*b*, 44, 46, 47, 49 are joined together using rivets 48 or a sewn attachment 70 which uses high-strength thread commonly used in the industry to join strapping. The shoulder straps 40*a*, 40*b*, inner slide strap 46, joining strap 47, and outer slide strap 49 are joined and arranged in such a manner as to transfer a force applied by the tether strap 33 to the leg straps 42*a*, 42*b* and the waist strap 44 (see FIG. 5) in a case of a fall. Additionally, the straps 40*a*, 40*b*, 42*a*, 42*b*, 44, 46, 47, 49 securely retain the user 80 within the confine of the tree stand 84.

Figure 5:
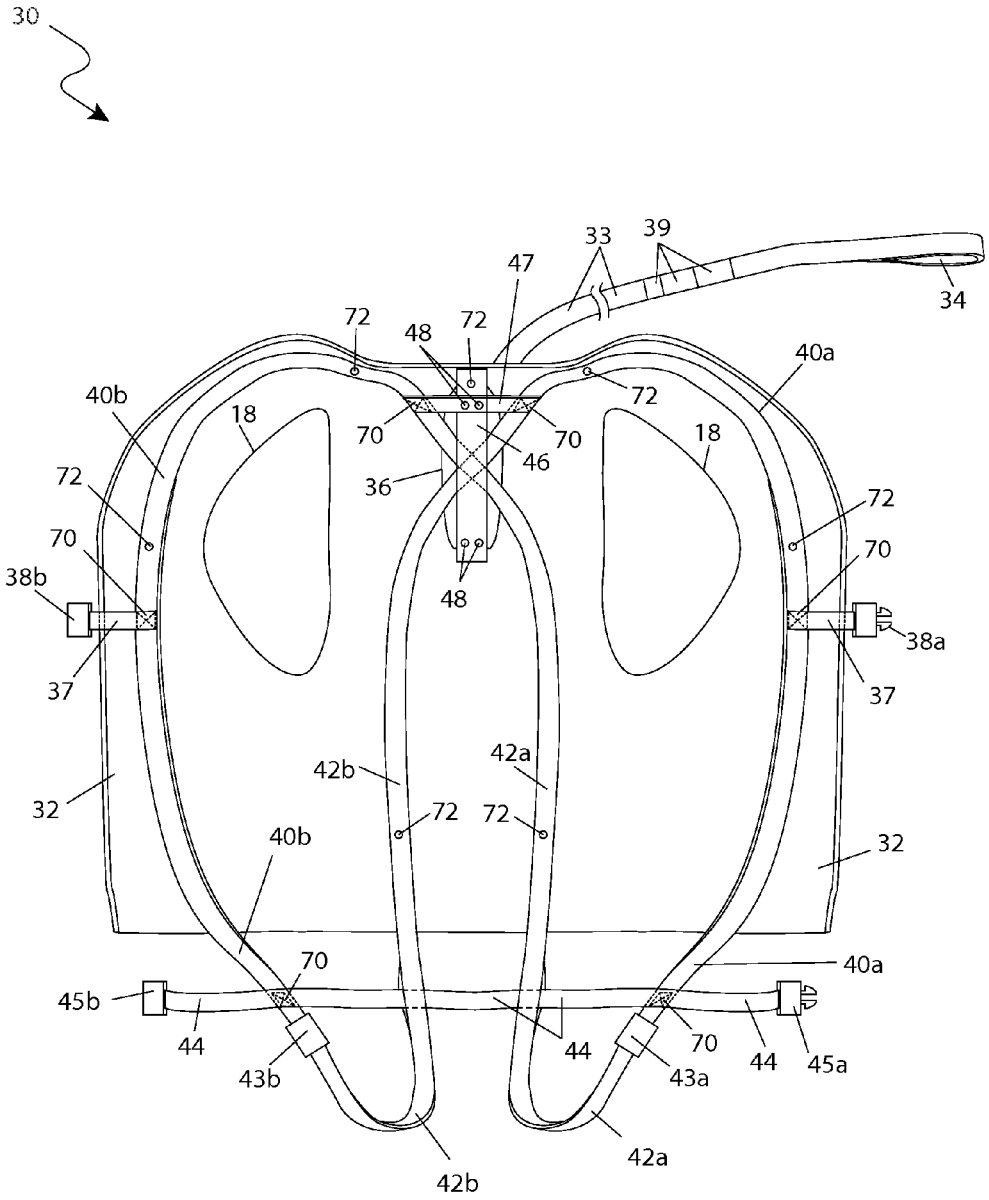
FIG. 5 is a front perspective view of the safety harness depicted in an open state, according to the preferred embodiment.

FIG. 5 shows a front perspective view of the safety harness 30 in an open state. The first 40*a* and second 40*b* shoulder straps are joined by a plurality of vest snap fasteners 72 to the harness vest 32 along respective left and right shoulder areas and extend downwardly along a front opening of the harness vest 32. The shoulder straps 40*a*, 40*b* culminate in a respective first leg strap buckle 43*a* and a second leg strap buckle 43*b* at an end of each shoulder strap 40*a*, 40*b*. The leg strap buckles 43*a*, 43*b* provide a removable attachment of the downwardly looping first leg strap 42*a* and the second leg strap 42*b*, respectively. The leg straps 42*a*, 42*b* subsequently extend upwardly and transition into the shoulder straps 40*a*, 40*b* and are joined by a plurality of snap fasteners 72 to a rear surface of the harness vest 32 in a crisscross pattern. The shoulder straps 40*a*, 40*b* provide additional support and are joined to each other along a neck area of the harness vest 32 by a joining strap 47 arranged horizontally and joined by a sewn attachment 70 to both shoulder straps 40*a*, 40*b*. The joining strap 47 in turn provides attachment for the inner slide strap 46 and outer slide strap 49 by a pair of rivets 48. The inner slide strap 46 and outer slide strap 49 include rectangular members abutted to each other in a vertical parallel manner and affixed to each other at ends by respective pairs of rivets 48, thereby forming a slot between in which the tether ring 35 slides vertically (see FIG. 6). The slot formed between the inner strap 46 and outer strap 49 provides a location for the leg straps 42*a*, 42*b* as they crisscross each other. The slot provides a flexible connection of the shoulder straps 40*a*, 40*b* and leg straps 42*a*, 42*b* to the remaining strap portions.

The shoulder straps 40*a*, 40*b* also provide a sewn attachment 70 for support to the waist strap 44 which is attached to the shoulder straps 40*a*, 40*b* adjacent to and slightly above the leg strap buckles 43*a*, 43*b*. The waist strap 44 extends in a circular fashion around the waist of the user 80 and includes ends which are ruggedly connected to each other by interlocking first waist strap buckle 45*a* and a second waist strap buckle 45*b*. The waist strap buckles 45*a*, 45*b* further provide integral features for the adjustment of a length of the waist strap 44 to snuggly fit the user 80.

Figure 6:
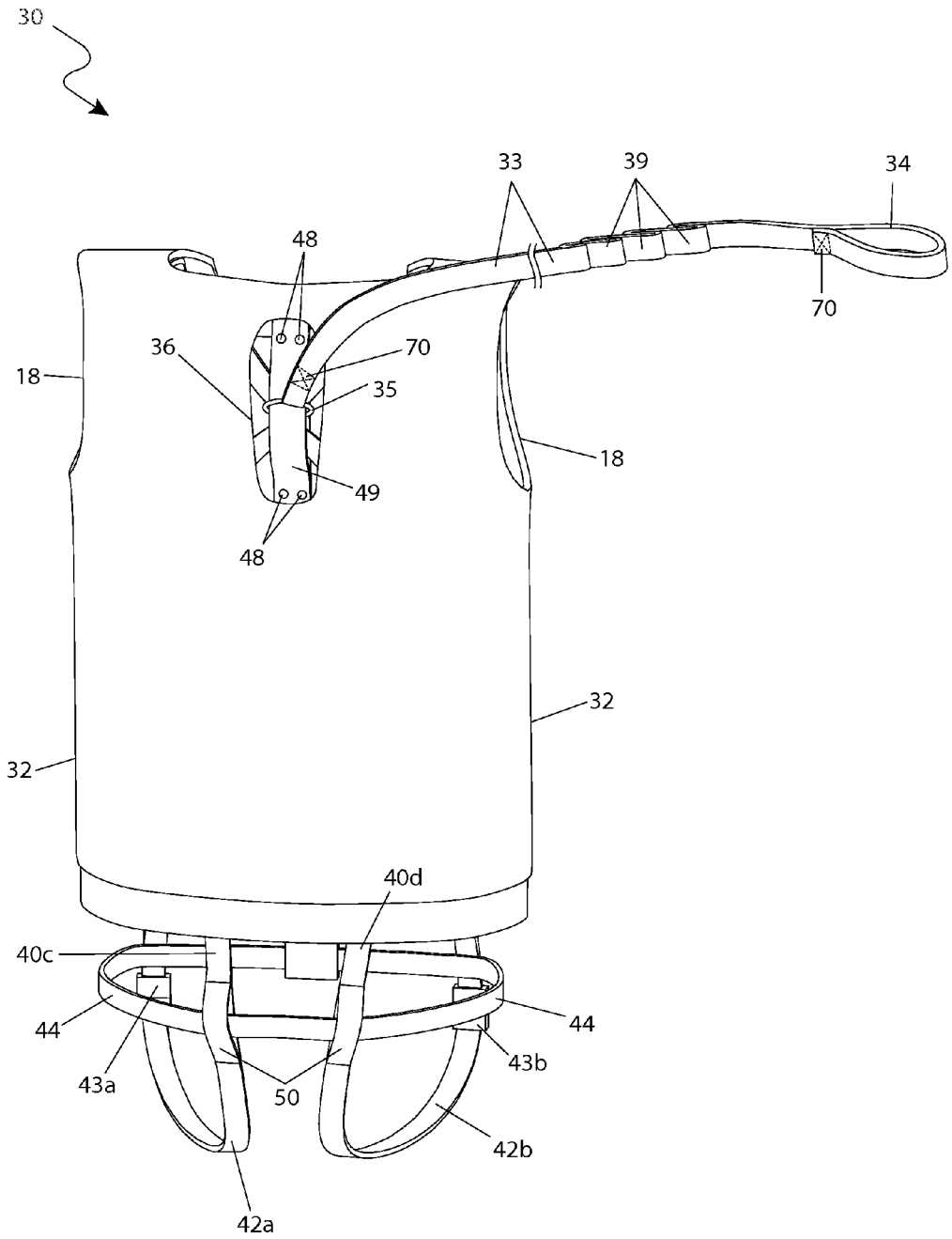
FIG. 6 is a rear view of the safety harness, according to the preferred embodiment.

FIG. 6 shows a rear perspective view of the safety harness 30. The harness vest 32 also includes a harness vest opening 36 which is a rectangular window approximately twelve (12) inches in height and two (2) inches in width located along an upper rear surface of the harness vest 32. The harness vest opening 36 provides access to the outer slide strap 49 of the safety harness 30. The tether ring 35 is slidingly inserted over the outer slide strap 49 which is riveted to the inner slide strap 46. The joined inner slide strap 46 and the outer slide strap 49 secure the tether ring 35 to the safety harness 30 and allows for vertical movement (also see FIG. 5). The tether ring 35 is affixed to the tether strap 33 by a sewn attachment 70. The sliding engagement of the tether ring 35 to the outer slide strap 39 allows vertical positioning of the attachment of the tether strap 33 to the user 80, thereby avoiding tangling, interference, and obstruction from the tether strap 33 while the user 80 positions himself or herself during a hunting or similar activity.

Figure 7:
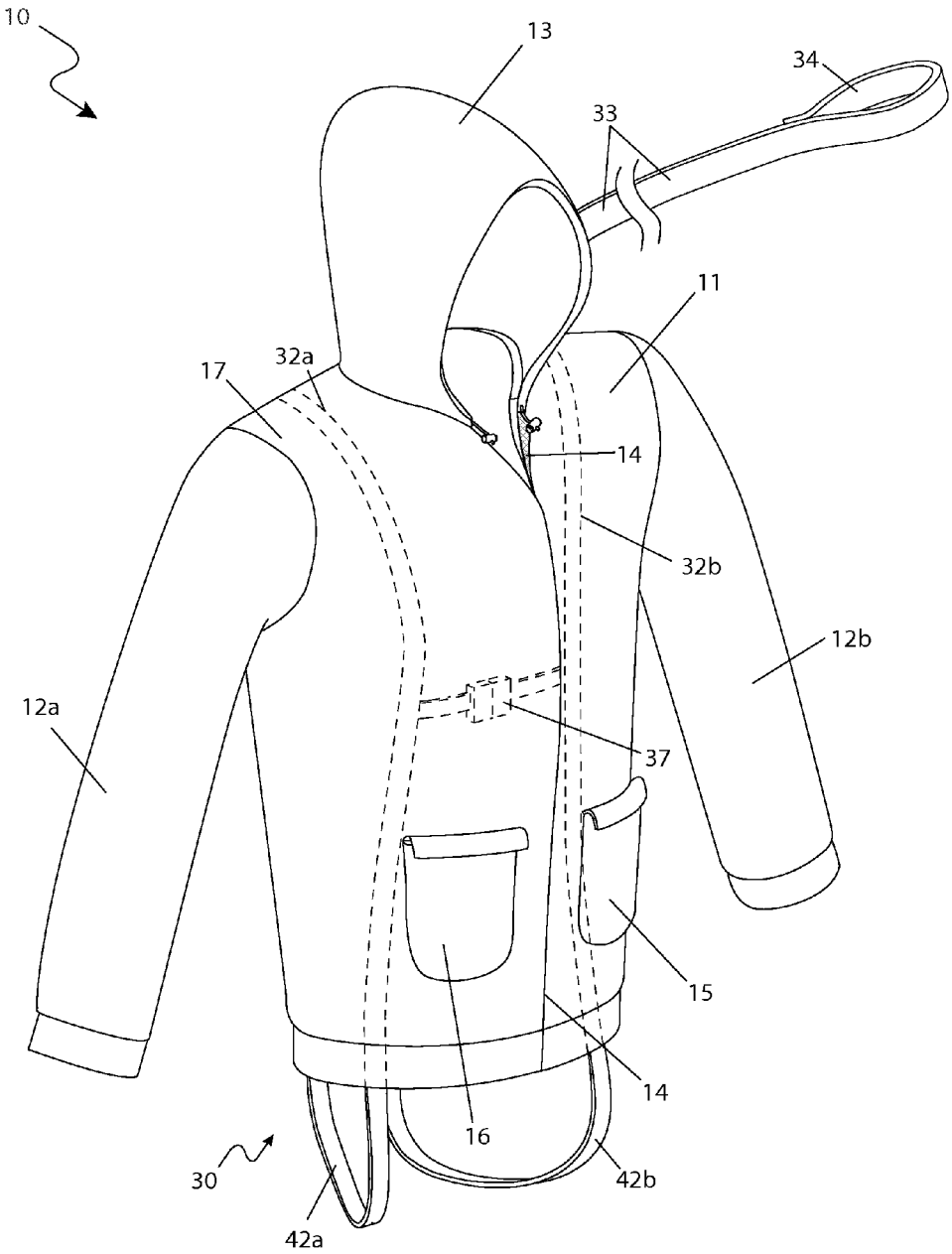
FIG. 7 is a front perspective view of the safety harness installed under the outer member, according to the preferred embodiment.

FIG. 7 shows a front perspective view of the safety harness 30 depicted as worn underneath the outer member 11. The hood 13 is depicted as detachably fastened onto the outer member 11 and in an as-worn state.

Figure 8:
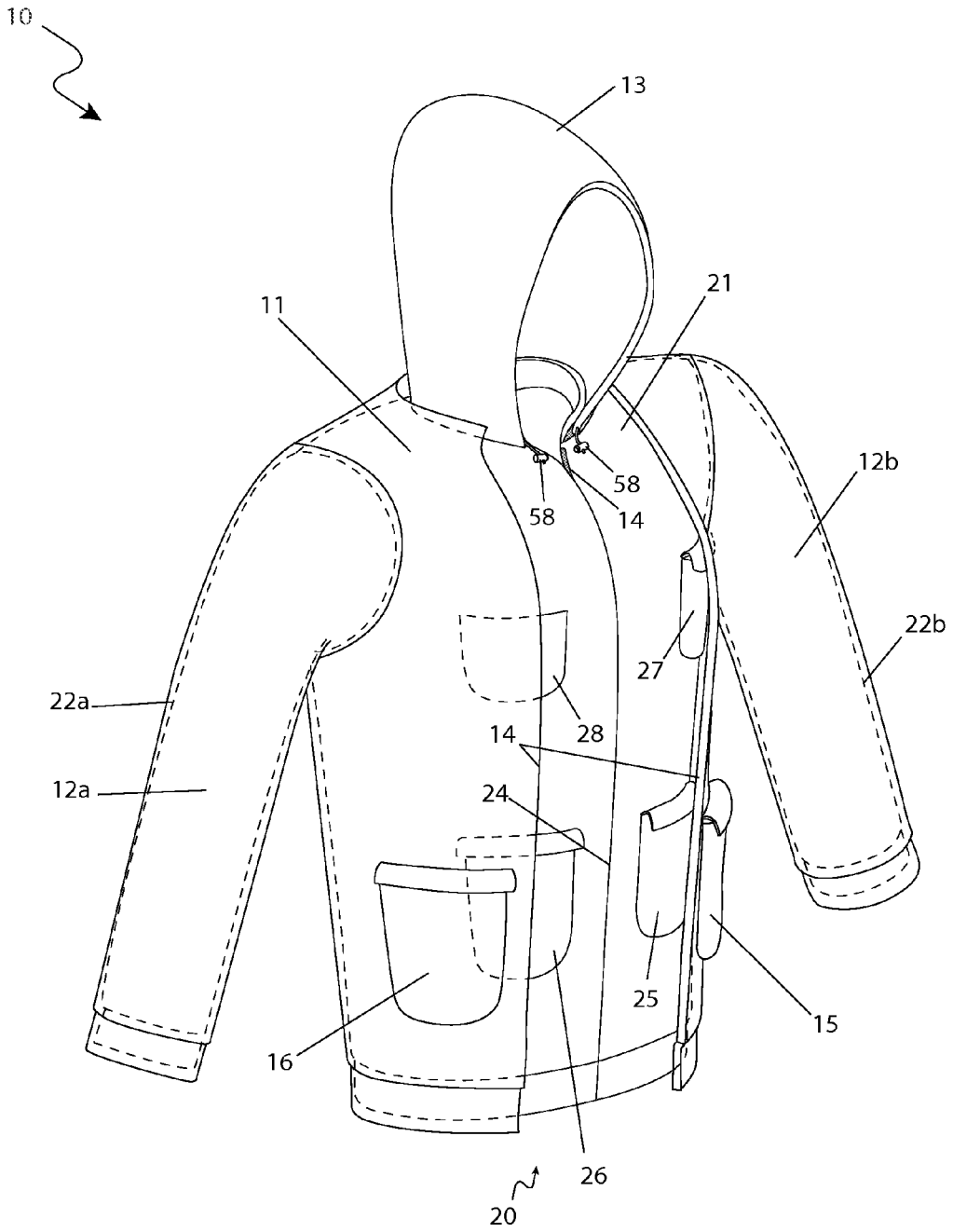
FIG. 8 is a front perspective view of the inner member installed under the outer member, according to the preferred embodiment.

FIG. 8 shows a front perspective view of the outer member 11 depicted as worn underneath the inner member 20. The outer member 11 is depicted in a partially open state revealing the inner member 20 as worn inside the outer member 11. The hood 13 is depicted as detachably fastened onto the inner member 20 and in a folded state which is useful in protecting the neck of the user 80 from the elements.

Figure 9:
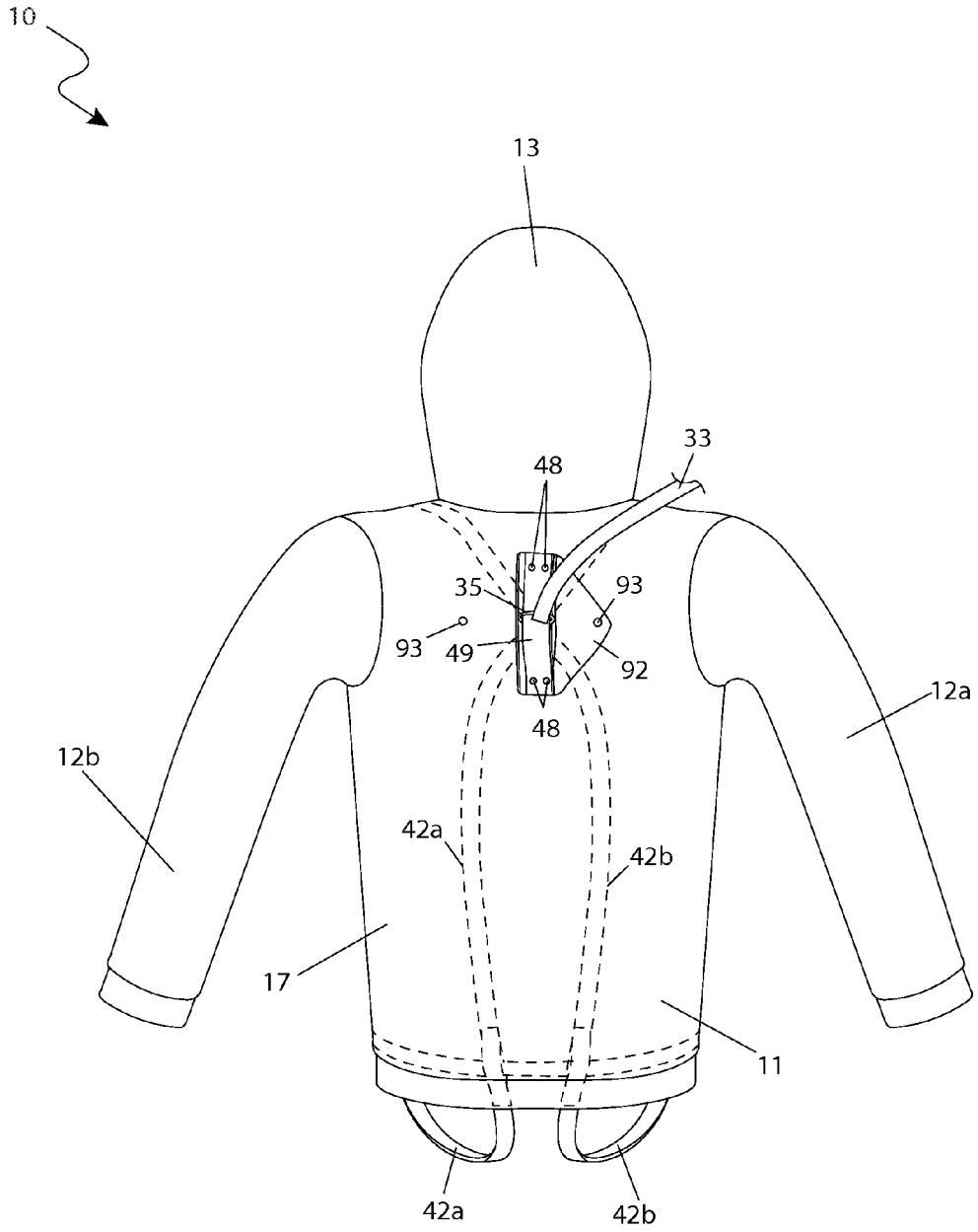
FIG. 9 is a rear perspective view of the safety harness installed under the outer member, according to the preferred embodiment.

FIG. 9 shows a rear perspective view of the outer member 11. The rear surface of the outer vest 17 includes a outer vest opening 90 similar to the harness vest opening 36 of the harness vest portion 32 as previously described. The outer vest opening 90 allows the user 80 to wear the outer member 11 over the safety harness 30 while maintaining the attachment and function of the tether strap 33. The outer vest opening 90 includes a concealing outer vest flap 92 for use when wearing the outer member 11 separately without the safety harness 30. The outer vest flap 92 is foldably affixed to a vertical edge of the outer vest opening 90 by a sewn attachment 70. The outer vest flap 92 includes an outer vest flap snap fastener 93 to provide a closure for the outer vest opening 90.

Figure 10:
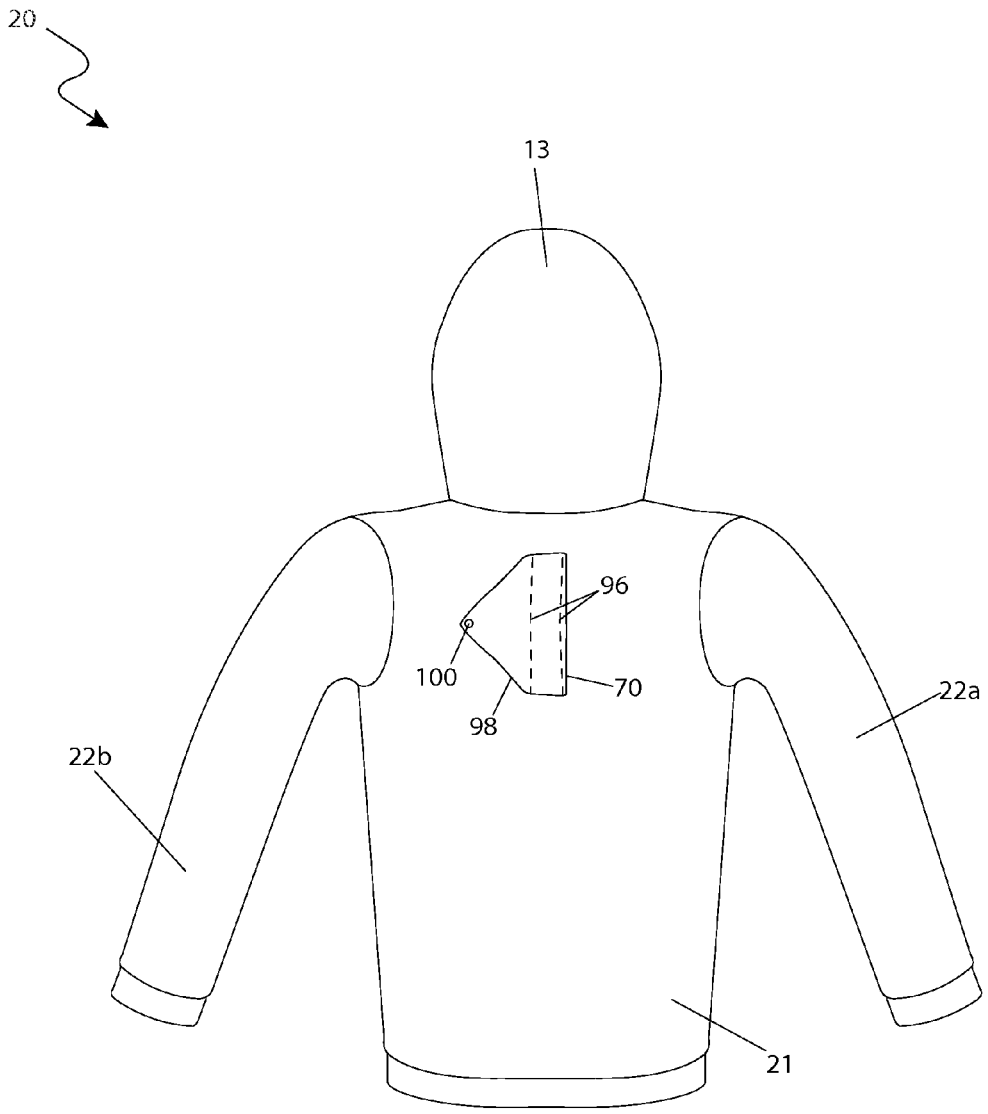
FIG. 10 is a perspective rear view of the inner member, according to the preferred embodiment.

FIG. 10 shows a rear perspective view of the inner member 20. The rear surface of the inner vest 21 includes an inner vest opening 96 similar to outer vest opening 90 of the outer member 11 described above. The inner vest opening 96 also allows the user 80 to utilize the tether strap 33 while wearing the inner member 21 beneath the outer member 11 or over the safety harness 30, or in combination between the outer member 11 and the safety harness 30; while maintaining the attachment and function of the tether strap 33. In a similar manner as the outer member 11, the inner member 20 includes an affixed inner vest flap 98 and an inner vest flap snap fastener 100 which provide closure of the inner vest opening 96 when wearing the inner member 21 separately without the safety harness 30.

Figure 11:
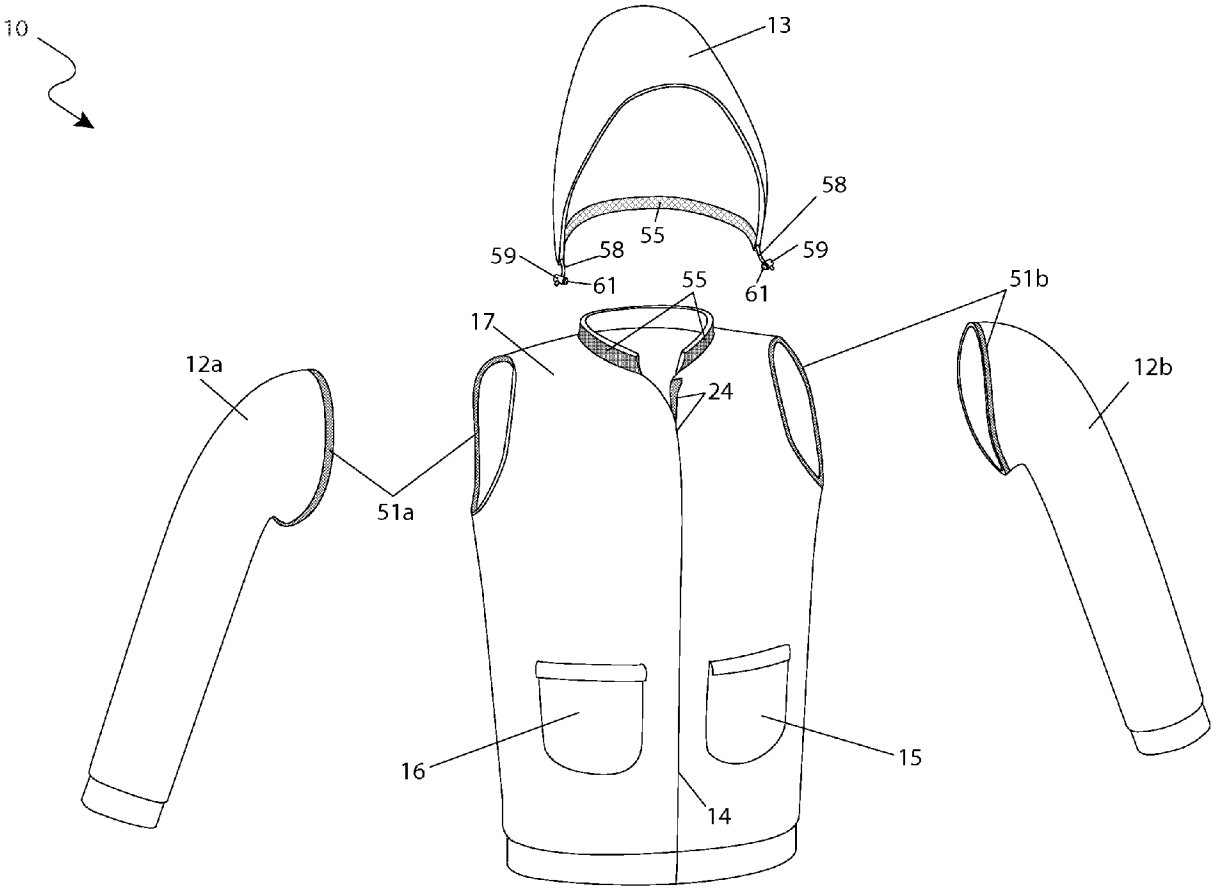
FIG. 11 is a front view perspective of the outer member depicted in a detached state, wherein a first sleeve, a second sleeve, and a hood have been detached from a first vest, according to the preferred embodiment.

FIG. 11 shows a front perspective view of the outer member 11 depicted with the first sleeve 12*a*, the second sleeve 12*b*, and the hood 13 detached from the outer vest 17. A first sleeve fastener Ma allows the first sleeve 12*a* to be detachably fastened onto the outer vest 17. In a similar manner, a second sleeve fastener 51*b* allows the second sleeve 12*b* to be detachably fastened onto the outer vest 17. A hood fastener 55 allows the hood 13 to be detachably fastened onto the outer vest 17. All fasteners 51*a*, 51*b*, 55 are preferably hook-and-loop type fasteners, zippers, snap fasteners, or the like.

Figure 12:
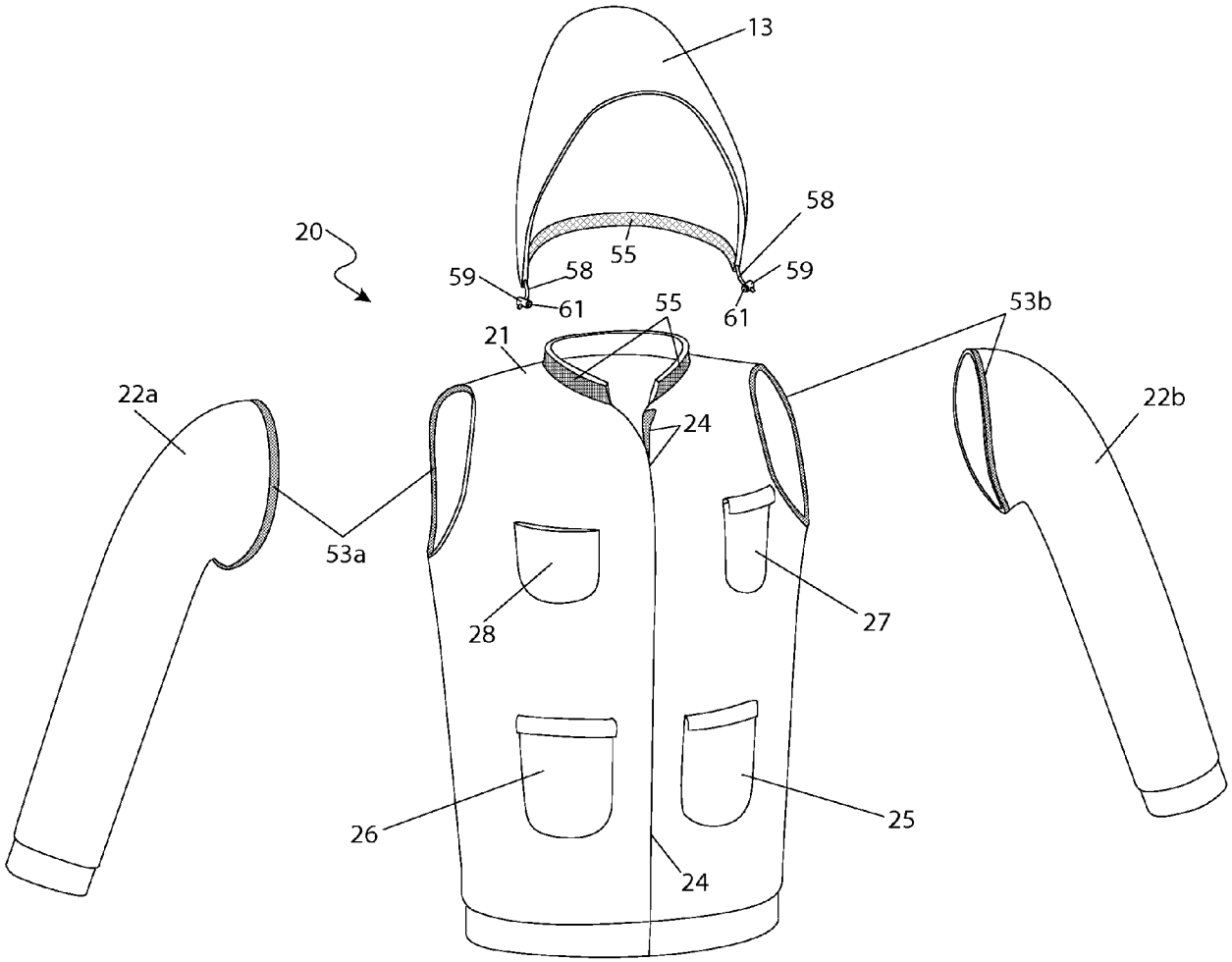
FIG. 12 is a front perspective view of the inner member depicted in a detached state, wherein a third sleeve, a fourth sleeve, and the hood have been detached from a second vest, according to the preferred embodiment; and, FIG. 13 is a close-up view of a plurality of tear-away folds of a tether strap, according to the preferred embodiment.

FIG. 12 shows a front perspective view of the inner member 20 depicted with the third sleeve 22*a*, the fourth sleeve 22*b* and the hood 13 detached from the inner vest 21. A third sleeve fastener 53*a* allows the third sleeve 22*a* to be detachably fastened onto the inner vest 21. In a similar manner, a fourth sleeve fastener 53*b* allows the forth sleeve 22*b* to be detachably fastened onto the inner vest 21. The hood fastener 55 allows the hood 13 to be detachably fastened onto the inner vest 21 in a manner similar to that shown in FIG. 7. All fasteners 53*a*, 53*b*, 55 are preferably hook-and-loop type fasteners, zippers, snap fasteners, or the like.

The hood 13 includes the hood fastener 55 and a hood adjusting string 58 which also has a pair of string barrels 59. Tightening of the hood adjusting string 59 allows the hood 13 to expose a lesser face portion of the user 80 to the elements, wherein the pair of string barrels 59 lock the position of the hood adjusting string 59 in a conventional manner by use of a spring loaded locking plunger 61 included within each string barrel 59. The hood 13 is preferably made of materials which are similar to those of the outer member 11 and inner member 20 and is detachably fastened onto either the outer vest 17 or the inner vest 21.

Figure 13:
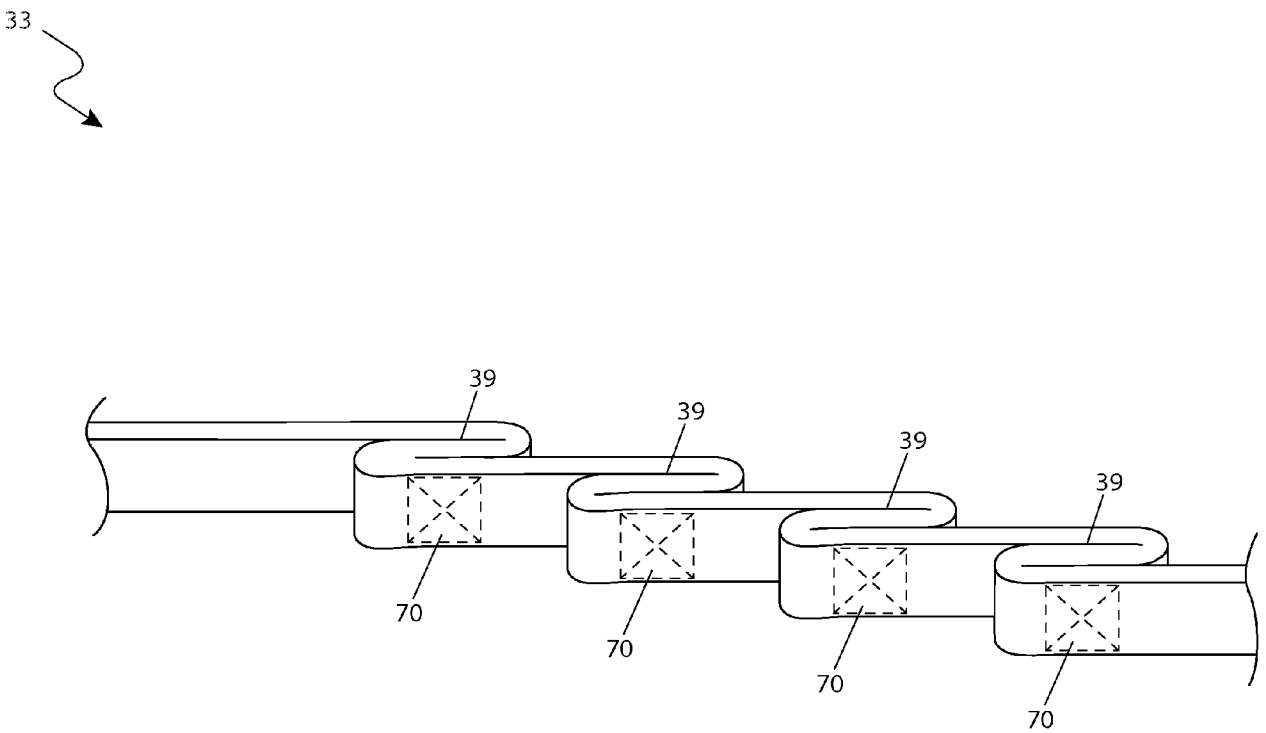

FIG. 13 shows a close-up view of a plurality of tear-away folds 39 of a tether strap 33. The tether strap 33 is preferably made of similar material as the shoulder straps 40*a*, 40*b* and includes a plurality of tear-away folds 39 which provide additional fall safety to the tether strap 33. In the event of a fall, the tether strap 33 will receive an abrupt tension force. The tear-away folds 39 are located at an intermediate portion of the tether strap 33 and are designed to tear away from one another and provide a resistance to the tensile force, reducing an impact, and decelerate the user 80 during the fall. Each tear-away fold 39 includes a double-folding of the strapping material of the tether strap 33 to form a three (3) layer section approximately two (2) inches in length. Each tear-away fold 39 is secured using a sewn attachment 70 and a thread sized to provide a desired breaking strength so as to break the fall of the user 80.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the common user in a simple and effortless manner with little or no training. After initial purchase or acquisition of the system 10, it would be utilized as indicated in FIGS. 1 through 12.

The method of utilizing the system 10 may be achieved by performing the following steps: selecting a desired system 10 configuration; donning the inner member 20; fastening the inner member 20 to the safety harness 30 using the vest snap fasteners 72; donning the outer member 11 over the inner member 20; donning and adjusting the hood 13 according to weather conditions; transporting the safety harness 30 and tree stand 84 sections to a desired hunting location; selecting an appropriate tree 81; assembling and installing the tree stand 84; adjusting the tether strap 33 length by raising or lowering the position of the tether ring 35; installing the safety harness 30 over the outer member 11; adjusting a length of the leg straps 42*a*, 42*b* using the leg strap buckles 43*a*, 43*b*; adjusting a length of the waist strap 44 using the waist strap buckle 45*a*, 45*b*; ascending onto the tree stand 84; passing the tree strap 60 through the tether loop 34; securing the tree strap 60 onto the tree 81; testing the safety of the tethering position; making final adjustments if needed; removing the tree strap 60 from the tree 81 after hunting; descending from the tree stand 84; removing the safety harness; removing and disassembling the tree stand 84; returning the safety harness 30 and the tree stand 84 sections to the home location of the user 80; removing the hood 13, the outer member 11 and the inner member 20; and, cleaning and storing the system 10.

The method of utilizing the system 10 in alternate configurations, such as wearing the outer member 11 individually, the outer vestp17 only, the inner member 20 individually, or the inner vest 21 only are achieved by performing similar steps in donning, wearing, and securing the safety harness 30 onto the trunk of the tree 81 and in installing the tree stand 84.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A hunting garment and safety harness system comprising:

a safety harness worn on a torso of a user comprising a harness vest, a plurality of adjustable straps affixed to an interior of said harness vest securable around said torso of said user, and a harness vest opening disposed through an upper middle location of said harness vest;

an inner member worn on said torso of said user comprising an inner vest, a pair of detachable sleeves, and an inner vest opening disposed through an upper middle location of said inner vest;

an outer member worn on said torso of said user comprising an outer vest, a pair of detachable sleeves, and an outer vest opening disposed through an upper middle location of said outer vest; and, a tether strap slidably coupled to a central location of said plurality of straps;

wherein said inner member is selectably wearable as a separate article and as combined over top of said safety harness;

wherein said outer member is selectably wearable as a separate article, as combined over top of said safety harness, and as combined over top of said inner member;

wherein said vest openings provide access for said tether strap to be coupled to said plurality of straps; and, wherein said vest openings align when said safety harness, said inner member, and said outer member are worn in combination.

2. The system of claim 1, wherein said plurality of straps further comprises:

a first shoulder strap and a second shoulder strap for looping around shoulders of said user and crisscrossing at said harness vest upper middle location;

a first leg strap and a second leg strap extending downwardly from said first shoulder strap and said second shoulder strap, each having a length adjustable buckle for looping around legs of said user;

a waist strap affixed to said first leg strap and said second leg strap having a length adjustable buckle on opposing ends for looping around a waist of said user;

a joining strap affixed between said first shoulder strap and said second shoulder strap;

an inner slide strap affixed to said joining strap and an interior of said harness vest; and, an outer slide strap affixed at opposing ends to said inner slide strap such that a slot is formed at said harness vest upper middle location;

wherein said outer slide strap is entirely accessible through said harness vest opening and said tether strap is slidably coupled to said outer slide strap and movable within said slot.

3. The system of claim 2, wherein said tether strap further comprises a plurality of tear-away folds disposed at an intermediate location;

wherein each of said plurality of tear away folds progressively pull apart and slow a descent of said user when falling.

4. The system of claim 3, wherein said tether strap further comprises a tether ring affixed to an end and a tether loop formed on an opposing end, said tether ring encircles said outer slide strap.

5. The system of claim 4, further comprising a detachable hood selectably fastened to a collar area of said inner vest;

wherein said detachable hood is selectably fastened to a collar area of said outer vest.

6. The system of claim 5, wherein said outer vest further comprises an outer vest flap affixed to an exterior for covering said outer vest opening.

7. The system of claim 6, wherein said inner vest further comprises an inner vest flap affixed to an exterior for covering said inner vest opening.

8. The system of claim 7, wherein said inner member further comprises a waterproof exterior layer, an interior layer, and insulation disposed between said exterior layer and said interior layer.

9. The system of claim 8, wherein said outer member further comprises a waterproof exterior layer, an interior layer, and insulation disposed between said exterior layer and said interior layer.

10. The system of claim 9, wherein said outer member further comprises at least one exterior pocket.

11. The system of claim 10, wherein said inner member further comprises at least one exterior pocket.

12. A hunting garment and safety harness system comprising:

a safety harness worn on a torso of a user comprising a harness vest, a plurality of adjustable straps affixed to an interior of said harness vest securable around said torso of said user, a harness vest opening disposed through an upper middle location of said harness vest;

an inner member worn on said torso of said user comprising an inner vest, a pair of detachable sleeves, an inner vest opening disposed through an upper middle location of said inner vest, and an inner vest flap affixed to an exterior for covering said inner vest opening;

a joining strap affixed to an interior of said harness vest;

an inner slide strap affixed to said joining strap and said harness vest interior; and, an outer slide strap affixed at opposing ends to said inner slide strap such that a slot is formed at said harness vest upper middle location; and, a tether strap slidably coupled to a central location of said plurality of straps, further comprising:

a tether ring affixed to an end, said tether ring encircles said outer slide strap;

a tether loop formed on an opposing end; and, a plurality of tear-away folds disposed at an intermediate location;

wherein each of said plurality of tear-away folds progressively pull apart and slow a descent of said user when falling;

wherein said inner member is selectably wearable as a separate article and as combined over top of said safety harness;

wherein said outer slide strap is entirely accessible through said harness vest opening and said tether strap is slidably coupled to said outer slide strap and movable within said slot;

wherein said inner vest opening aligns with said harness vest opening when worn in combination to provide access for said tether strap to be coupled to said outer slide strap; and, wherein said harness vest opening provide access for said tether strap to be coupled to said plurality of straps.

13. The system of claim 12, wherein said plurality of straps further comprises:

a first shoulder strap and a second shoulder strap for looping around shoulders of said user and crisscrossing at said harness vest upper middle location;

a first leg strap and a second leg strap extending downwardly from said first shoulder strap and said second shoulder strap, each having a length adjustable buckle for looping around legs of said user;

a waist strap affixed to said first leg strap and said second leg strap having a length adjustable buckle on opposing ends for looping around a waist of said user.

14. The system of claim 12, further comprising an outer member worn on said torso of said user comprising an outer vest, a pair of detachable sleeves, an outer vest opening disposed through an upper middle location of said outer vest, and an outer vest flap affixed to an exterior for covering said outer vest opening;

wherein said outer member is selectably wearable as a separate article and as combined over top of said safety harness; and, wherein said outer vest opening aligns with said harness vest opening when worn in combination to provide access for said tether strap to be coupled to said outer slide strap.

15. The system of claim 14, wherein said plurality of straps further comprises:

a first shoulder strap and a second shoulder strap for looping around shoulders of said user and crisscrossing at said harness vest upper middle location;

a first leg strap and a second leg strap extending downwardly from said first shoulder strap and said second shoulder strap, each having a length adjustable buckle for looping around legs of said user;

a waist strap affixed to said first leg strap and said second leg strap having a length adjustable buckle on opposing ends for looping around a waist of said user.

16. The system of claim 12, further comprising:

an inner member worn on said torso of said user comprising an inner vest, a pair of detachable sleeves, an inner vest opening disposed through an upper middle location of said inner vest, and an inner vest flap affixed to an exterior for covering said inner vest opening; and, an outer member worn on said torso of said user comprising an outer vest, a pair of detachable sleeves, an outer vest opening disposed through an upper middle location of said outer vest, and an outer vest flap affixed to an exterior for covering said outer vest opening;

wherein said inner member is selectably wearable as a separate article and as combined over top of said safety harness;

wherein said outer member is selectably wearable as a separate article, as combined over top of said safety harness, and as combined over top of said inner member; and, wherein said vest openings align when worn in combination to provide access for said tether strap to be coupled to said outer slide strap.

* * * * *